US005568237A

United States Patent [19]

Ishida et al.

[11] Patent Number: 5,568,237

[45] Date of Patent: Oct. 22, 1996

[54] TONER BOX HAVING AXIALLY SPACED AND TRAPEZOIDAL, FLEXIBLE AGITATING MEMBERS

[75] Inventors: Kazuhito Ishida, Nagoya; Hiroshi Tokuda, Anjo; Shinji Kimura, Kani, all of Japan

[73] Assignee: Brother Kogyo Kabushiki Kaisha, Nagoya, Japan

[21] Appl. No.: 597,198

[22] Filed: Feb. 6, 1996

Related U.S. Application Data

[62] Division of Ser. No. 432,922, May 1, 1995, Pat. No. 5,506, 665.

[30] Foreign Application Priority Data

May 12, 1994 [JP] Japan ..... 6-98476
May 12, 1994 [JP] Japan ..... 6-98477
May 12, 1994 [JP] Japan ..... 6-98478

[51] Int. Cl.[6] ..... G03G 15/08

[52] U.S. Cl. ..... 355/260; 222/DIG. 1; 355/245; 366/279; 366/292; 366/309; 366/329.1

[58] Field of Search ..... 355/245, 260; 118/653; 222/DIG. 1, 167, 228, 233, 236, 238–240; 366/279, 292, 309, 312, 329.1

[56] References Cited

U.S. PATENT DOCUMENTS 3,689,035 9/1972 List ..... 366/309 X
4,937,628 6/1990 Cipolla et al. ..... 355/260
5,078,303 1/1992 Kikuchi et al. ..... 222/167
5,160,963 11/1992 Haneda et al. ..... 355/260 X
5,220,382 6/1993 Hediger ..... 355/245
5,287,151 2/1994 Sugiyama ..... 355/260
5,384,629 1/1995 Watanabe et al. ..... 355/260
5,489,976 2/1996 Ichikawa ..... 355/260

FOREIGN PATENT DOCUMENTS 3-53232 11/1991 Japan .
4-48232 8/1992 Japan .

OTHER PUBLICATIONS

English–language translation of Japanese Patent Publication No. 3–53232.

*Primary Examiner*—Arthur T. Grimley
*Assistant Examiner*—Sophia S. Chen
*Attorney, Agent, or Firm*—Oliff & Berridge

[57] ABSTRACT

An elongated toner box extending in a horizontal direction has a cylindrical portion where a toner discharge port is formed. A wrapping member serving as a shutter is rotatably disposed over the cylindrical portion for selectively shutting off the toner discharge port. The wrapping member has a circular shape concentrical with the cylindrical portion. A developing case is provided to which the toner box is detachably installable. The developing case has a wall confronting the toner box, and a toner inlet port is formed at the wall. A toner inlet shutter is slidably movably supported to the partition wall. When the wrapping member opens and closes the toner discharge port, the wrapping member is positioned close to the outer surface of the toner box and does not largely protrude from the toner box. Further, the discharge port shutter and the inlet port shutter are movable in interlocking relation with each other.

28 Claims, 11 Drawing Sheets

TONER BOX HAVING AXIALLY SPACED AND TRAPEZOIDAL, FLEXIBLE AGITATING MEMBERS

This is a Division of application No. 08/432,922 filed May 1, 1995 and now U.S. Pat. No. 5,506,665.

BACKGROUND OF THE INVENTION

The present invention relates to a developing device for use in an electrophotographic image forming apparatus such as a laser printer, copying machine, facsimile, etc., and more particularly, to a toner box structure which accommodates therein developing agents or toners.

In a conventional dry developing type, developing agents such as magnetic or non-magnetic toners are supplied to a developing region at a surface of a photosensitive drum for performing developing operation. Such type is described in a Japanese Patent Publication No. Hei 4- 48232. In the disclosed device, a developing sleeve is housed in a developing case positioned in the vicinity of the photosensitive drum. The developing sleeve has an inner peripheral surface in which a magnetic roller is disposed and an outer peripheral surface on which the developing agents are carried. A toner box is provided detachably from the developing case so as to supply the developing agents from the toner box to the developing case.

A toner discharge port is formed in the toner box and a toner inlet port is formed in the developing case. These ports are aligned with each other when installing the toner box into the developing case. Further, a lid member which shuts off the toner discharge port and another lid member which shuts off the toner inlet port are provided. The toner discharge port and the toner inlet port are communicated with each other for the toner supply if these two lid members are aligned with each other and pulled out.

However, with the above structure, the two lid members are pulled linearly in a direction to project out of the bodies of the toner box and the developing case. Thus, the pulled out lid members are largely protruded laterally of the toner box and the developing case, which may be bulky. Further, since the inner surfaces of the lid members are attached with toner particles, the protruding lid members may contaminate the ambient components or portions.

Further, has been known an image recording apparatus such as a printer and a copying machine where a sheet cassette is provided detachable with respect to a main frame thereof. However, with the above structure, no specific relationship is provided between the operation for opening the lid member of the toner box and operation for installing the sheet cassette. As a result, if the lid is not open while the toner box is installed onto the developing case, i.e., if the image recording operation is started by supplying a sheet from the sheet cassette while the toner supply cannot be performed from the toner box to the developing case, toner shortage occurs in the developing case. Therefore, a desired imaging quality cannot be obtained. If the image recording operation continues while the toners are completely used up, the developing sleeve and the photosensitive drum may be damaged.

Furthermore, the attachment direction of the toner box with respect to the developing case is important. If the toner box is attached to the developing case in an erroneous attachment direction, the toner discharge port and the toner inlet port are misaligned from each other, so that opening and closing movement of the lid member which covers the toner discharge port of the toner box cannot be performed concurrently with the movement of the lid member which covers the toner inlet port of the developing case. Further, due to the misalignment with the ports, toners may be spilt outside.

SUMMARY OF THE INVENTION

It is therefore, an object of the present invention to overcome the above described problems, and to provide a developing device in which a shutter member adapted to shut off the toner discharge port of the toner box is not bulky, and no contamination by toners occurs even by the opening and closing movement of the shutter member.

Another object of the present invention is to provide the developing device in which the shutter member which closes the toner discharge port of the toner box and the other shutter member which closes the toner inlet port of the developing case can be opened or closed interlockingly with each other for facilitating handling.

Further, in the present invention, attention is drawn to the fact that the image recording operation cannot be started unless the sheet cassette is installed to the image recording apparatus. Thus it is a further object of the present invention to provide the developing device in which the sheet cassette can be installed in association with the opening operation of the shutter members, provided that the shutter members are moved to open the toner discharge port and the toner inlet port, so that the image recording operation cannot be performed in a state where the toner is not supplied from the toner box to the developing case, whereby safety image recording operation can be provided without damaging to the developing components.

Still another object of the present invention is to provide the developing device in which the toner box can be correctly installed to the developing case without mistaking attachment direction.

These and other objects of the present invention will be attained by providing an improved developing device for use in an image recording apparatus which includes a main frame and a photosensitive unit. The developing device includes a developing case, a toner box and a wrapping member. In the developing case developing agent is filled for supplying the developing agent to the photosensitive unit. The developing case has an arcuate wall formed with a toner inlet port. The toner box is detachably installable on the developing case. The toner box includes an elongated hollow member having at least a cylindrical portion where is formed a toner discharge port confrontable with the toner inlet port. The cylindrical portion has an outer peripheral surface. The wrapping member has a circular shape concentrical with the cylindrical portion and has a wall portion defining a discharge port shutter. The wrapping member is concentrically movable along the outer peripheral surface of the cylindrical portion of the toner box in a first direction and a second direction opposite the first direction for selectively opening and closing the toner discharge port by the discharge port shutter.

BRIEF DESCRIPTION OF THE DRAWINGS

In the drawings:

FIG. 17(*b*) is a schematic cross-sectional view showing the part of the second wrapping member disengaged from the projection of the cylindrical part of the toner box.

DETAILED DESCRIPTION OF THE PREFERRED EMBODIMENTS

Figure 1:
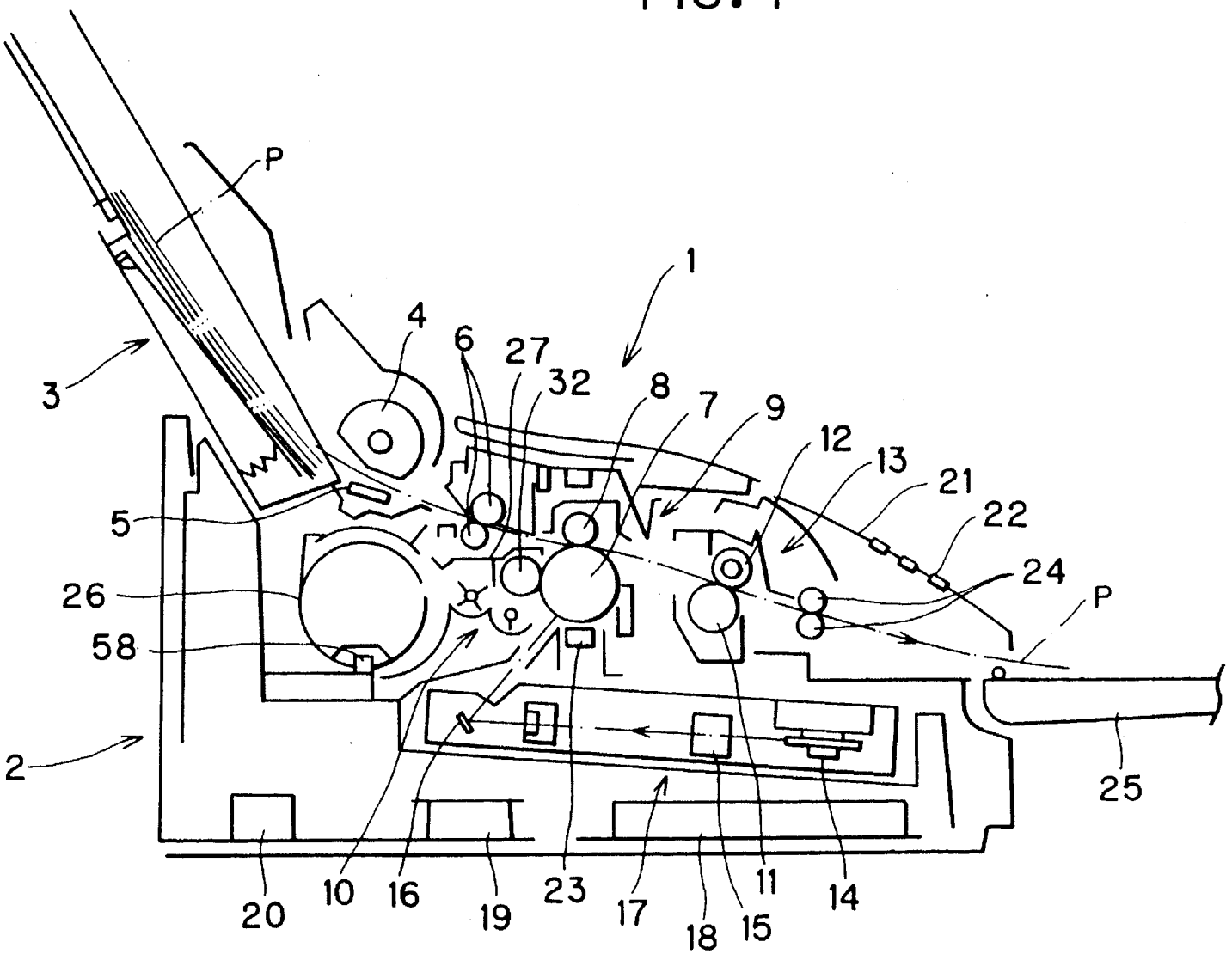
FIG. 1 is a schematic cross-sectional side view showing a laser printer in which a developing device according to an embodiment of the present invention is installed.

A developing device according to one preferred embodiment of the present invention will be described. A printer 1 as an image recording apparatus is shown in FIG. 1 in which the developing device 10 of the embodiment is incorporated.

The printer 1 has a main frame 2 and a sheet cassette 3 provided detachably from an upper one side of the main frame 2. In the printer 1, a sheet supply roller 4 and a separation pad 5 are provided for separating one sheet P from a remaining sheets of a sheet stack in the cassette 3. A pair of sheet feed rollers 6 are disposed downstream of the sheet supply roller 4 for feeding the sheet P to a photosensitive unit 9. The photosensitive unit 9 includes a photosensitive drum 7 and a transfer roller 8.

A developing device 10 is provided in the vicinity of the photosensitive unit 9 and at a position close to the sheet cassette 3, whereas a fixing unit 13 is positioned opposite the developing device 10 with respect to the photosensitive unit 9. The developing device 10 includes a a developing case 27 fixed in the main frame 2, a toner box 26 provided detachably with respect to the developing case 27, and a developing sleeve 32 positioned in contact with the photosensitive drum 7. The fixing unit 13 includes a heat roller 11 and a pressure roller 12.

At a position below the photosensitive unit 9, are disposed a scanner unit 17, a control board 18, 19 and a power unit 20 etc. The scanner unit 17 includes a laser emitting portion 14, a lens 15, and a reflection mirror 16, etc. A keyboard 22 having a plurality of operation button is provided on a cover member 21. A charger 23 is provided for electrically charging the photosensitive drum 7. Further, a toner sensor 58 is provided to detect the toner amount in the toner box 26. A pair of discharge rollers 24 are provided downstream of the fixing unit 13, and a discharge tray 25 is provided downstream of the discharge rollers 24.

Incidentally, the developing system according to the depicted embodiment is of two components type developing system which contains 95 to 98% by weight of magnetic carrier and 2 to 5% by weight of non-magnetic toners. However, 1.5 component type developing system is also available which contains 30 to 80% by weight of magnetic carrier and 20 to 70% by weight of magnetic toners.

Figure 2:
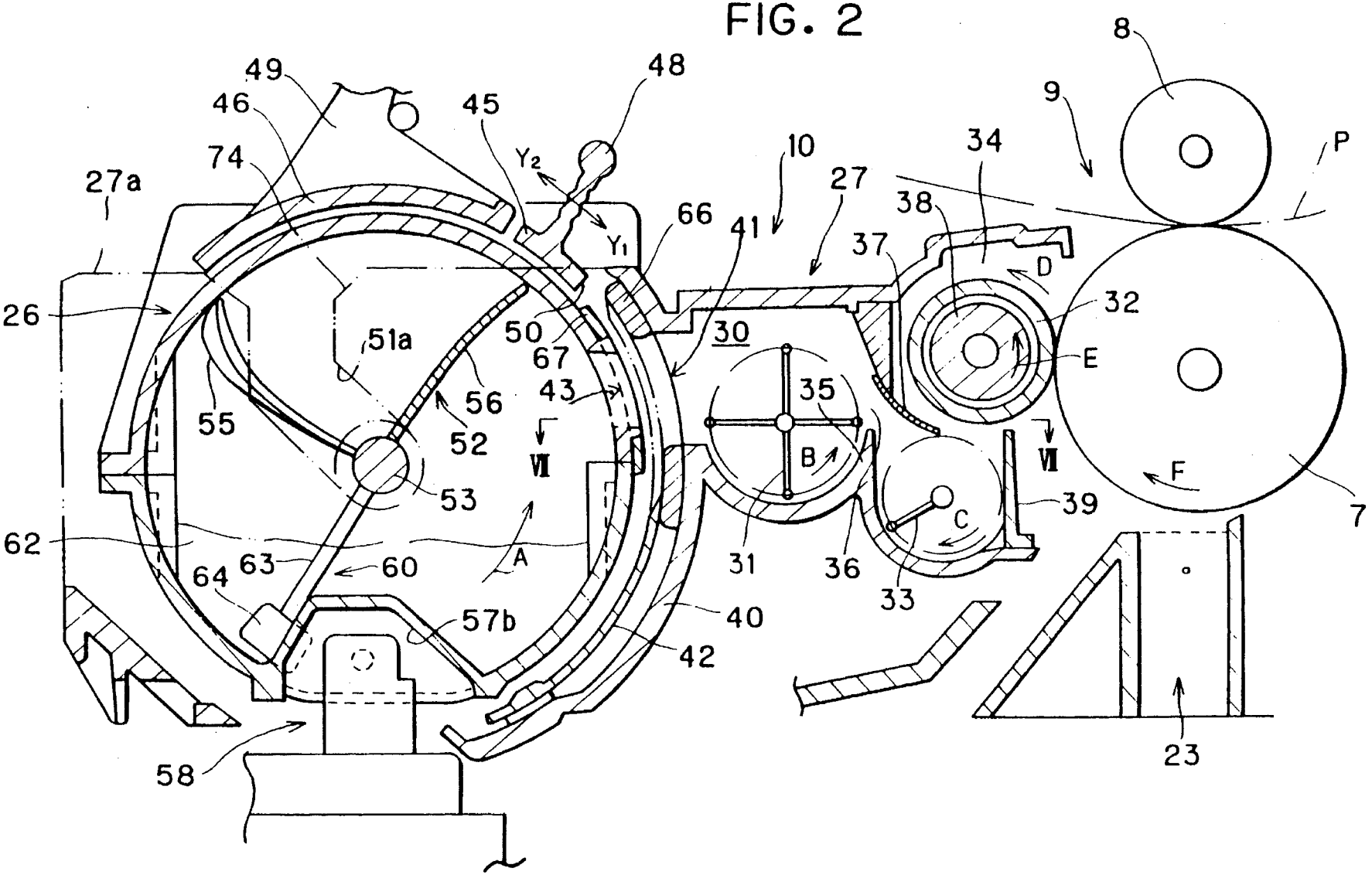
FIG. 2 is a partly cross-sectional side view showing an essential portion of the developing device according to the embodiment.

Detailed arrangement of the developing device 10 is best shown in FIG. 2. The developing device 10 has the developing case 27 made of a synthetic resin in which an agitation chamber 30 and a developing chamber 34 are partitioned from each other by a partition wall 35. The partition wall 35 is formed with an opening 36 which con fronts a full length of a peripheral side of the developing sleeve 32.

Figure 7:
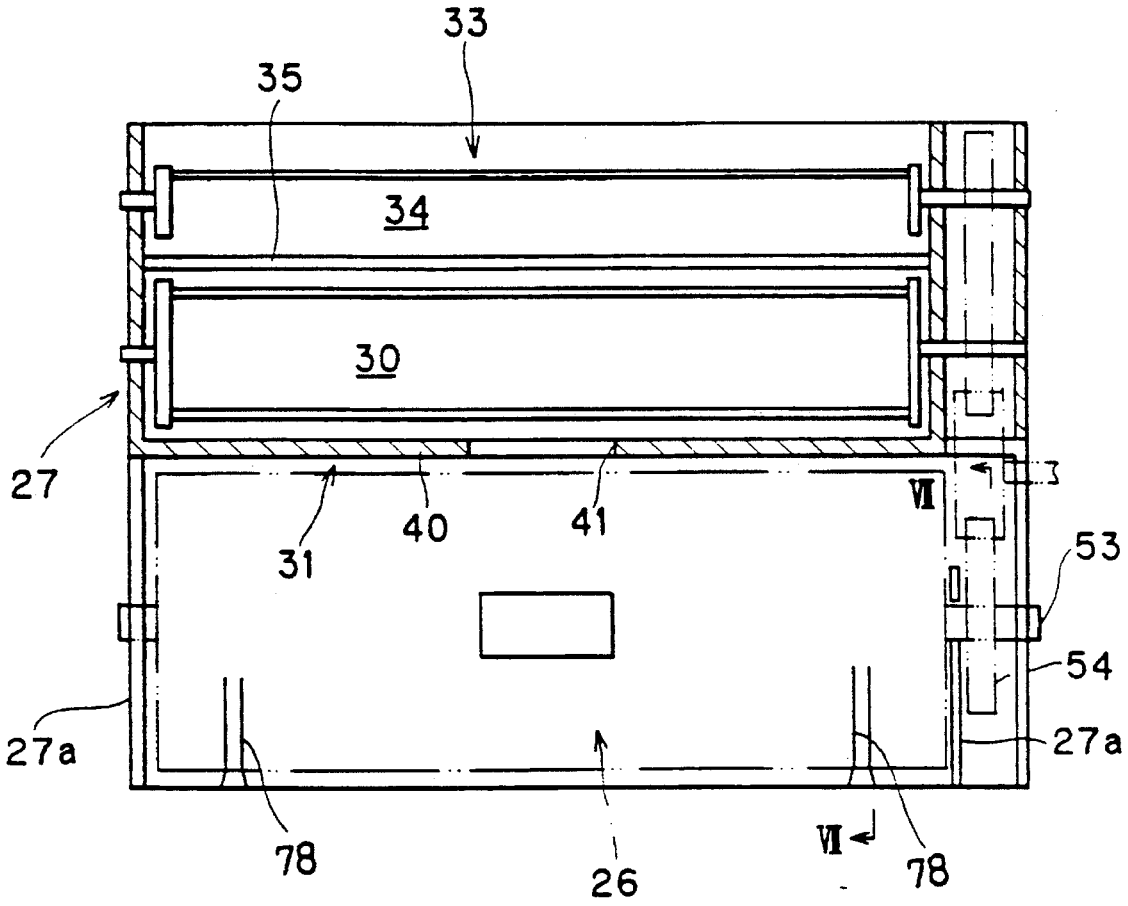
FIG. 7 is a cross-sectional view taken along the line VII—VII of FIG. 2.

In the developing chamber 34, the developing sleeve 32 and a first agitator 33 (See FIGS. 2 and 7) are provided. The developing sleeve 32 has an inner peripheral portion in which a magnetic roller 38 is disposed rotatably. The magnetic roller has N poles and S poles alternately arrayed in the circumferential direction thereof. The outer sleeve portion of the developing sleeve 32 is rotatable in a direction indicated by an arrow D, whereas the magnetic roller 38 is rotatable in a direction indicated by an arrow E. The developing sleeve 32 is positioned in the vicinity of the photosensitive drum 7 rotatable in a direction indicated by an arrow F. An outer peripheral surface of the developing sleeve 32 is in confrontation with an outer peripheral surface of the photosensitive drum 7 for transferring toners to the outer peripheral surface of the drum 7.

The first agitator 33 is disposed below the developing sleeve 32 and includes a crank rod etc. extending along a full length of the developing sleeve 32. The first agitator 33 is provided angularly rotatably in a direction indicated by an arrow C.

At a position adjacent the opening portion 36, a regulation member 37 is attached to the partition wall 35. The regulation member 37 is formed of magnetically permeable film such as PET (polyethylene terephthalate) having a resiliency. An intermediate portion of the regulation member 37 extends downwardly into the developing chamber 34 and confronts the outer peripheral surface of the developing sleeve 32. Further, a free end of the regulation member 37 is positioned adjacent an outer side of a rotational locus of the first agitator 33.

Within the developing chamber 34 and at a position adjacent the outer peripheral surface of the photosensitive drum 7, a trimmer blade 39 is provided for regulating a thickness of a layer of the developing agents carried by the magnetic carriers.

Figure 5:
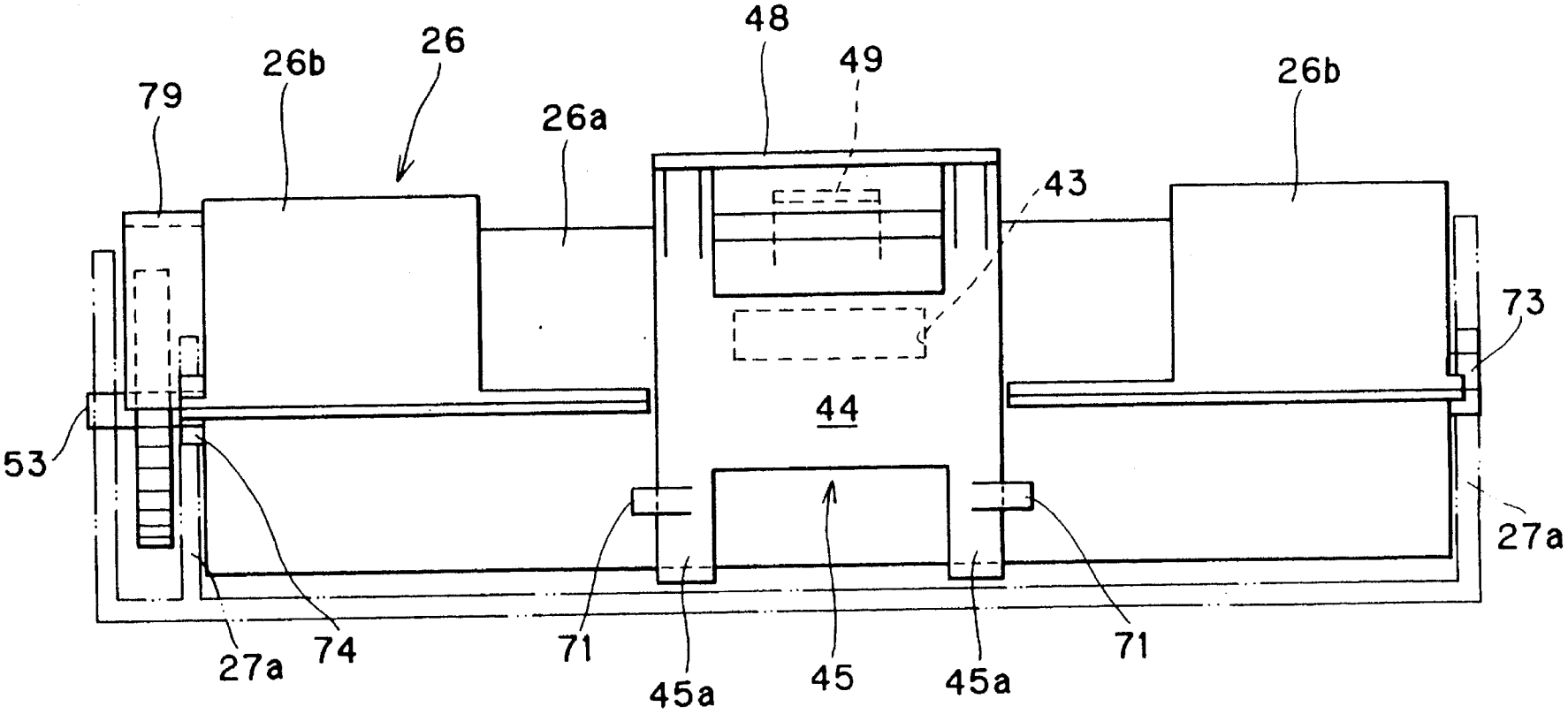
FIG. 5 is a front view of the toner box.

In the agitation chamber 30, a second agitator 31 (see FIGS. 2 and 7) such as a paddle wheel is provided rotatably in a direction indicated by an arrow B. The second agitator 31 includes a plurality of agitation rod extending along a full length of the developing sleeve 32 within the agitation chamber 30. As described later, the toner box 26 is detachably supported on the case 27 for supplying toners toward the agitation chamber 30. The case 27 has both sides provided with a pair of bracket portions 27*a* (see FIGS. 2, 3 and 5) at left side and right side thereof for detachably supporting the toner box 26 at the bracket portions 27*a* as described later.

Next, a structure of the toner box 26 and a structure for installing the toner box will be described with reference to FIGS. 2 through 16. The toner box is adapted to supply the developing agents such as magnetic toners or non magnetic toners to the agitation chamber 30.

Figure 8:
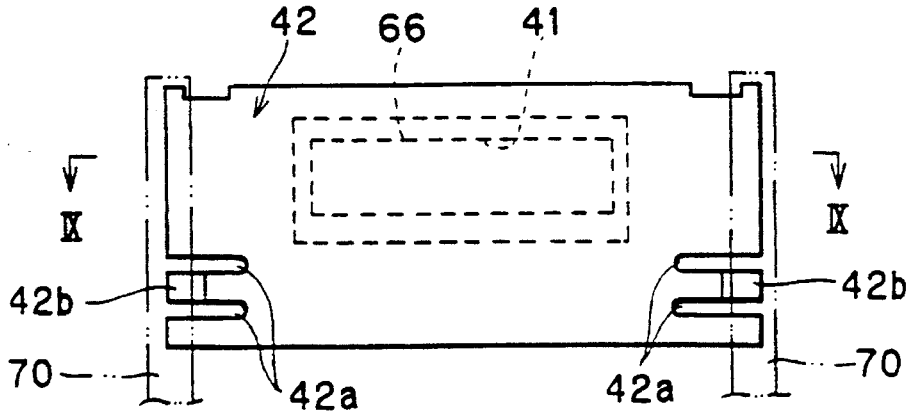
FIG. 8 is a front view showing a shutter for closing a toner inlet port according to the embodiment.

In the developing case 27 and at one side of the agitation chamber 30 (at a position opposite the partitioning wall 35), an arcuate partitioning wall 40 is provided. The partitioning wall 40 serves as a part of an outer contour of the developing case 27, the outer contour being in confrontation with the toner box 26. Further, a toner inlet port 41 is formed at the partitioning wall 40, so that the toners from the toner box 26 can be supplied to the agitation chamber 30 through the port 41. The toner inlet port 41 is positioned at an intermediate portion of the partition wall 40 and has an elongated rectangular shape and extends in a horizontal direction as best shown in FIG. 8.

Figure 10:
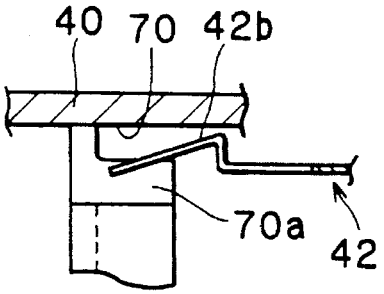
FIG. 10 is a view for description of a state where the shutter of FIG. 8 is engaged with an engagement opening portion according to the embodiment.
Figure 11:
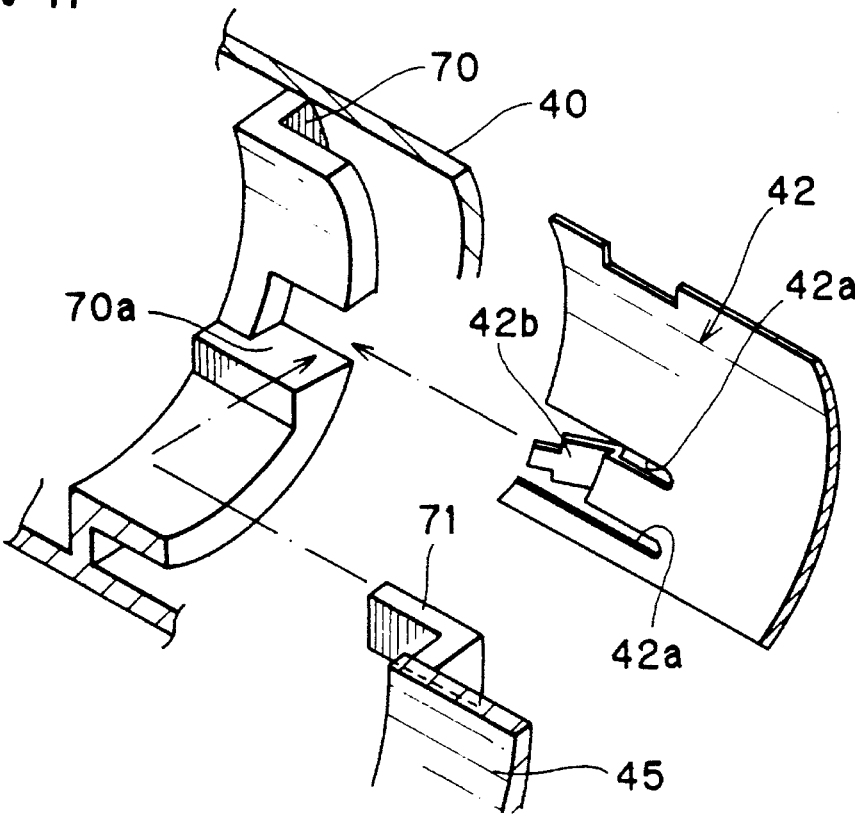
FIG. 11 is a schematic perspective view showing an essential portion of the shutter and a guide groove according to the embodiment.
Figure 12:
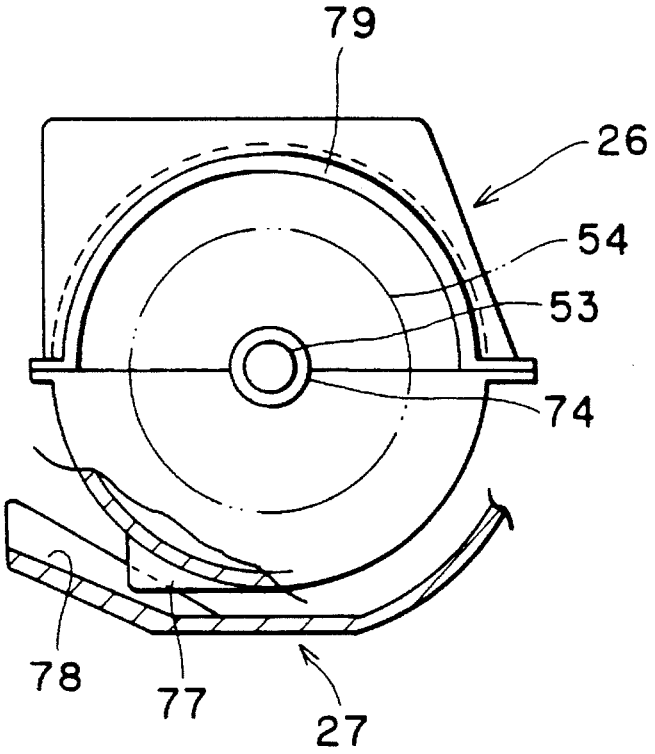
FIG. 12 is a cross-sectional view taken along the line XII—XII of FIG. 7.
Figure 13:
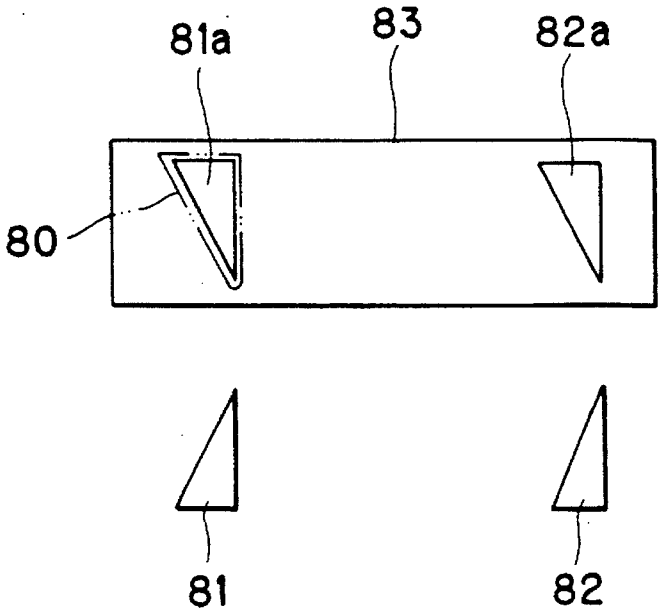
FIG. 13 is a view for description of marks in the embodiment.

As shown in FIGS. 2, an inlet port shutter 42 is movably provided for shutting off the toner inlet port 41. The inlet port shutter 42 has an arcuate shape in cross-section and is formed of a thin metal plate such as, for example, aluminum or stainless steel plate. As shown in FIGS. 8 through 11, the right and left side edge portions of the inlet port shutter 42 are guided by a pair of right and left guide grooves 70, 70 provided at a side face of the partition wall 40 nearest the toner box 26, so that the inlet port shutter 42 is movable in an arcuate locus. At right and left sides of the inlet port shutter 42, resiliently deformable locking pawl pieces 42*b* are provided between upper and lower cut-away grooves 42*a*, 42*a*. Further, a pair of locking openings 70*a* (FIGS. 10 and 11 shows one of the locking openings) are provided by cutting away a portion of the guide grooves 70. The resiliently deformable locking pawl pieces 42*b* are engageable with the respective locking openings 70*a* for fixing angular rotational position of the inlet port shutter 42 with respect to the partitioning wall 40. If the inlet port shutter 42 is moved to a position shown by a solid line in FIG. 2, along the grooves 70, the toner inlet port 41 is opened. If the inlet port shutter 42 is moved to a position shown by a two dotted chain line in FIG. 2 along the grooves 70, the toner inlet port 41 is shut off by the inlet port shutter 42.

Figure 3:
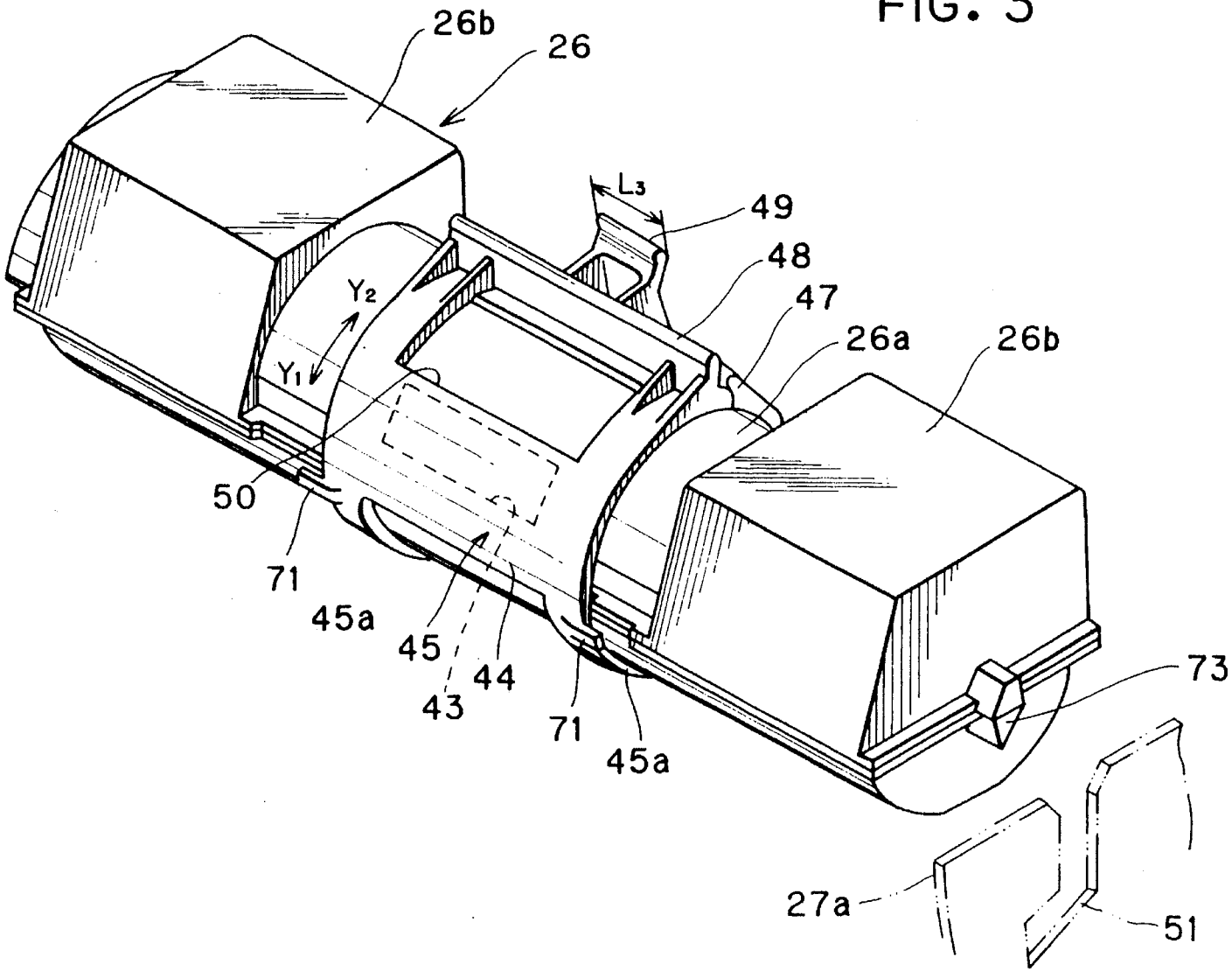
FIG. 3 is a perspective view as viewed from one side of the toner box according to the embodiment.
Figure 4:
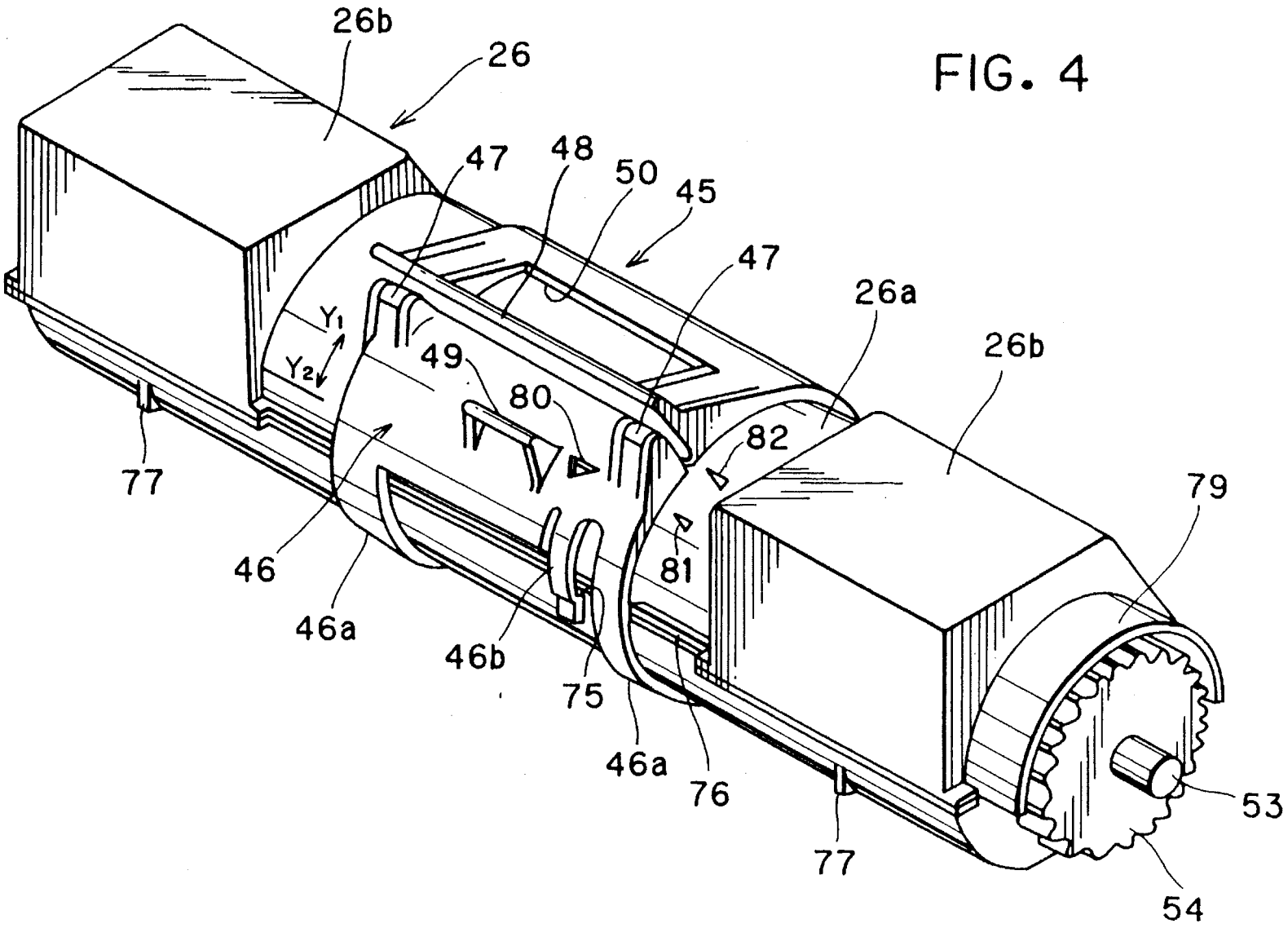
FIG. 4 is a perspective view as viewed from opposite side of the toner box.

As shown in FIGS. 3 and 4, the toner box 26 has a lower portion having a semi-cylindrical portion, upper right and left portions 26*b* having a hexahedron shape and an intermediate portion 26*a* having a cylindrical shape. As a whole, the toner box 26 has an elongated sleeve shape in a longitudinal or horizontal direction thereof. Since the right and left side portions 26*b* have a hexahedronic or boxy shape, toner containing amount within the toner box can be increased in comparison with a toner box having a fully cylindrical shape. The toner box 26 is formed of a translucent material colored with a brown color such as acrylic resin and polycarbonate resin. The box 26 is provided by joining upper and lower semicylindrical case halves together. A projection 76 (see FIGS. 4 and 16) is provided at the mating face between the upper and lower semicylindrical case halves of the toner box 26.

FIG. 2 shows a cross-section of the intermediate cylindrical portion 26*a* of the toner box 26 installed in the developing case 27. In a state where the toner box 26 is installed into the case 27, the intermediate portion 26*a* of the toner box 26 and the arcuate partitioning wall 40 of the case 27 are positioned concentrically.

At one side of the intermediate portion 26*a* of the toner box 26, a toner discharge port 43 is formed at a position confrontable with the toner inlet port 41 of the agitation chamber 30. That is, as also shown in FIG. 3, the toner discharge port 43 extends in a horizontal direction at an intermediate location of the intermediate portion 26*a*.

A first wrapping member 45 (see also FIG. 3) having a semicylindrical shape is rotatably disposed over the outer peripheral surface of the intermediate portion 26*a*. The first wrapping member 45 is formed with an opening 50 alignable with the toner discharge port 43 by an angular rotation of the first wrapping member 45. The first wrapping member 45 has a portion serving as a shutter portion 44 for shutting off the toner discharge port 43 by angular rotation of the first wrapping member 45. In other words, the part 44 of the wall of the first wrapping member 45 serves as the shutter member 44.

Further, a second wrapping member 46 (see also FIG. 4) having a semicylindrical shape is rotatably disposed over the outer peripheral surface of the intermediate portion 26. That is, the first wrapping member 45 and the second wrapping member 46 have arcuate walls to surround the intermediate portion 26*a*. These wrapping members 45 and 46 are connected together by a hinged portion 47 provided at upper ends thereof. Further, lower ends of the first and second wrapping members 45, 46 are provided with leg portions 45*a*, 46*a* at which an engagement pawl (not shown) and an engagement hole (not shown) are provided. The engagement pawl is detachably engageable with the engagement hole. The first and second wrapping members 45, 46 have operation knobs 48, 49 extending therefrom so that an operator can grip the knob for rotating the first and second wrapping members 45, 46 together. Two knobs 48 and 49 are required so that the operator can access one of the knobs 48, 49 for rotating the wrapping members after the toner box 26 is installed into the developing case 27. After installation, the operator's hand must be inserted into a narrow space in the image recording apparatus for access of one of the knobs.

Figure 16:
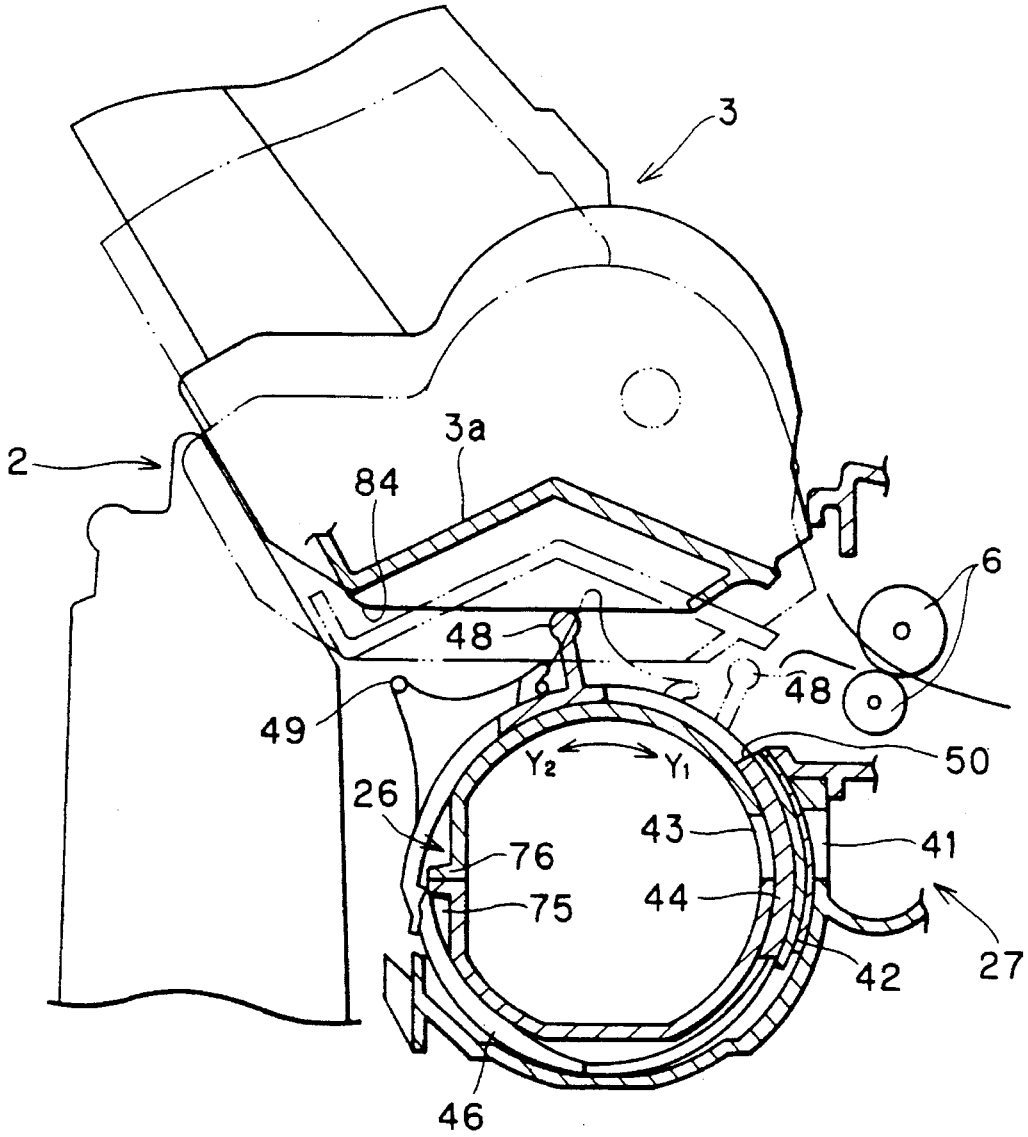
FIG. 16 is a cross-sectional side view showing geometrical relationship between a lower end portion of a sheet cassette and a knob portion according to the embodiment.

The operation knob 48 has a first angular position as shown by a dotted chain line in FIG. 16 where the opening 50 of the first wrapping member 45 is in alignment with the toner discharge port 43 so as to open the toner discharge port 43. The operation knob 48 has a second angular position or vertically orienting position as shown by a solid line in FIG. 16 where the toner discharge port 43 is shut off by the shutter portion 44.

In order to angularly move the first and second wrapping members 45, 46 in the direction indicated by an arrow Y2, the knob portion 49 is accessible. Thus, the knob portion 49 is gripped and moved so that the discharge port shutter 44 shuts off the toner discharge port 43. On the other hand, in order to angularly move the first and second wrapping members 45, 46 in a direction indicated by an arrow Y1 in FIGS. 2 and 3, the knob portion 48 is accessible. Thus the knob portion 48 is gripped and moved so that the upper opening 50 is brought into confrontation with the toner discharge port 43 to open the port 43. The knob portion 49 is required for moving the wrapping members 45, 46 in the direction Y2, since the other knob portion 48 is not accessible when the knob 48 is in the first angular position (dotted chain line position).

The second wrapping member 46 has a resiliently deformable arm 46*b* (FIG. 4) extending in a circumferential direction of the cylindrical part 26*a* of the toner box 26. The deformable arm 46*b* has a tip end portion provided with a locking pawl 75 projecting radially inwardly. The locking pawl 75 is engageable with the projection 76 at the mating face between the upper and lower semicylindrical case halves of the toner box 26 prior to installation of the toner box into the developing case 27. Therefore, the discharge port shutter 44 which closes the toner discharge port 43 is positioned immovably for maintaining the closing state as shown in FIG. 17(*a*).

Figure 17A:
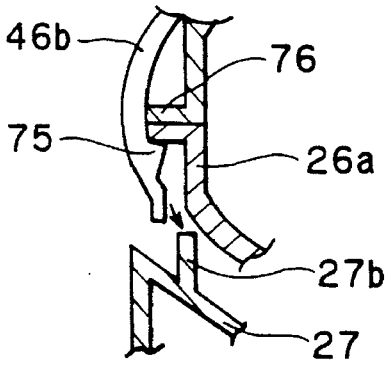
FIG. 17(*a*) is a schematic cross-sectional view showing a part of a second wrapping member engaged with a projection of a cylindrical part of the toner box.
Figure 17B:
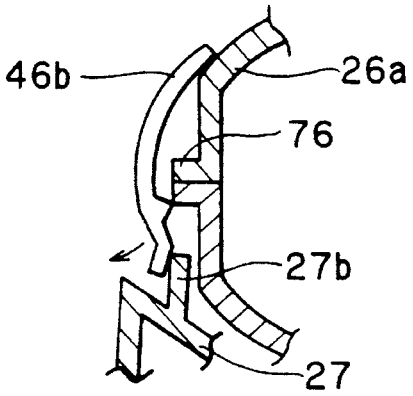

On the other hand, as shown in FIGS. 17(*b*), the developing case 27 has a protrusion 27*b* engageable with the locking pawl 75. If the toner box 26 is correctly installed to the developing case 27, the protrusion 27*b* is brought into engagement with the locking pawl 75, so that the locking pawl 75 is disengaged from the projection 76 because of the resilient deformation of the deformable arm 46*b*. Thus, the second wrapping member 46 can become rotatable.

Figure 9:
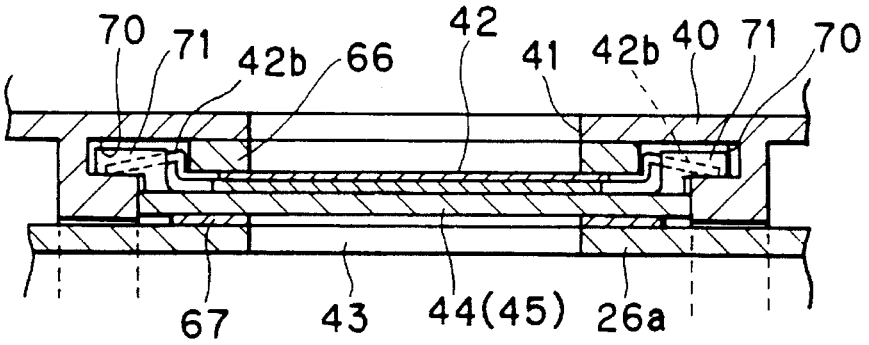
FIG. 9 is an enlarged cross-sectional view taken along the line IX—IX of FIG. 8.

Resilient sealing members 66, 67 made of felt material, etc. are affixed to outer perimeters of the toner inlet port 41 and the toner discharge port 43 (see also FIGS. 8 and 9). When the shutters 42, 44 are in closed positions, these sealing members seal boundaries between the shutters 42, 44 and the ports 41, 43. When the shutters 42 44 are in open positions, the sealing members 66, 67 are in abutment with each other to avoid accidental leakage of the toners 62.

Figure 14:
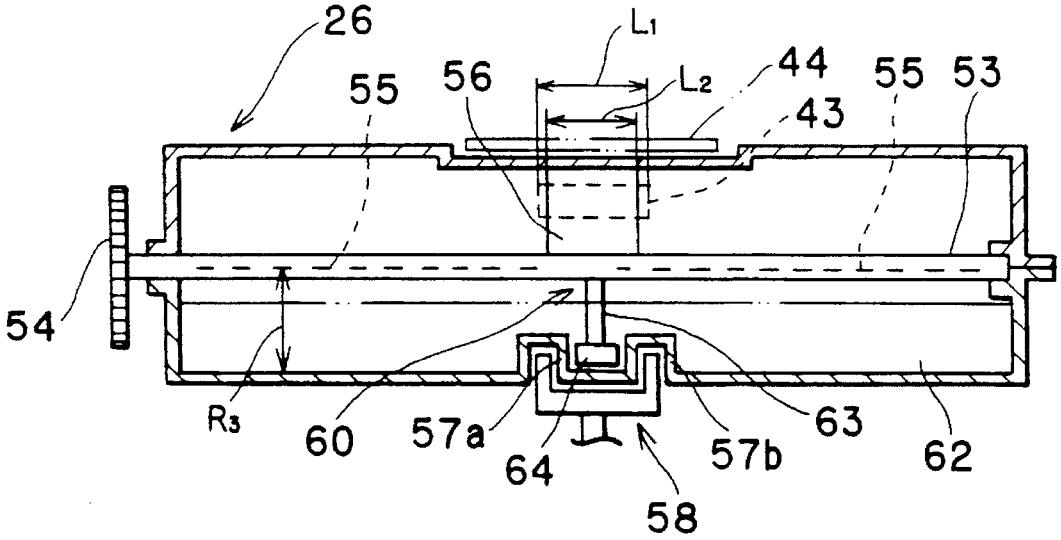
FIG. 14 is a cross-sectional view showing an agitator in the toner box according to the embodiment.
Figure 15:
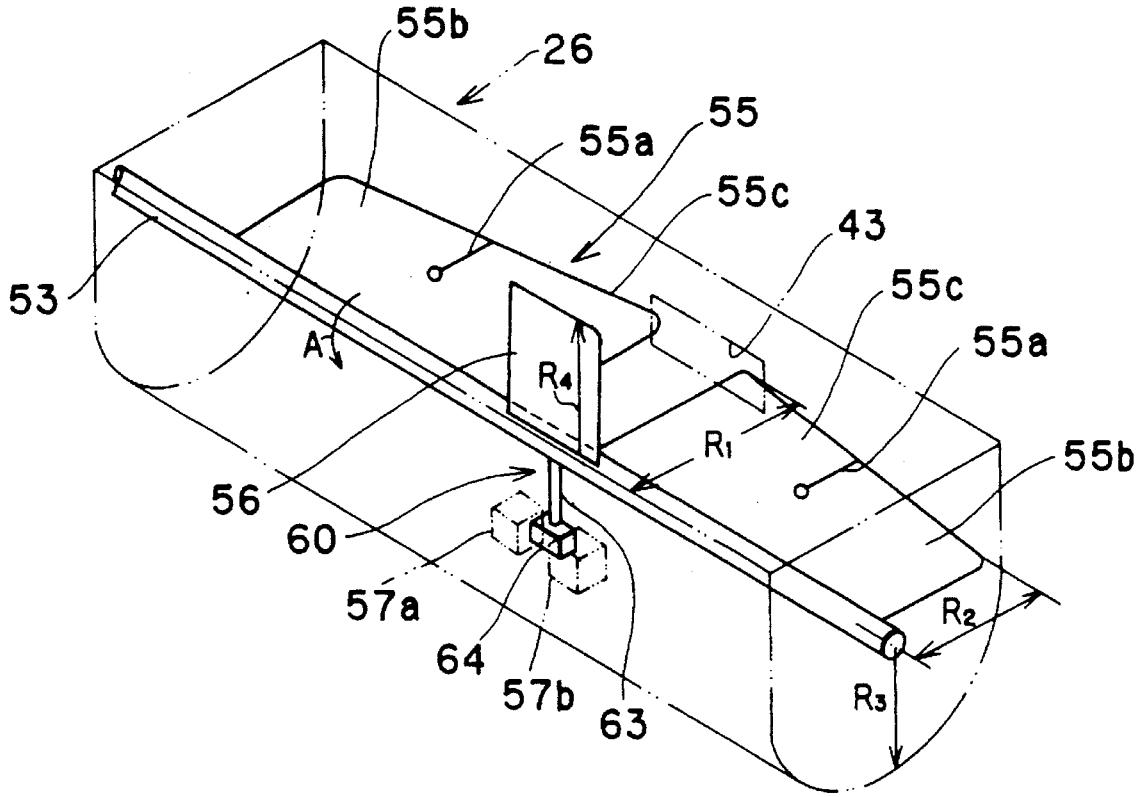
FIG. 15 is a perspective view showing the agitator in the toner box.

As also shown in FIGS. 14 and 15, an agitator 52 is disposed within the toner box 26. The agitator 52 includes a rotation shaft 53, first agitation members 55, 55 and a second agitation member 56. The rotation shaft 53 rotatably extends through the toner box 26. A rotation shaft 53 has one end protruding from one end of the toner box 26 and is fixed with a gear 54. A main motor (not shown) is provided for rotating the rotation shaft 53 in a direction indicated by the arrow A through a power transmission mechanism (not shown).

The first agitation members 55, 55 and second agitation member 56 are fixed to the rotation shaft 53 and extend radially outwardly with an angular interval of 90 degrees between the first and the second agitation members. The first agitation members are positioned at right and left sides of the toner box and are formed of a flexible material such as polyester resin film (polyethylene terephthalate film), and the second agitation member 56 is positioned at a position movable past the toner discharge port 43 and is formed of the identical polyester resin film. The second agitation member 56 serves as an agitation/transfer member.

As shown in FIG. 15, with respect to a dimension of the first agitation member 55, the first agitation member 55 has a trapezoidal shape in which a radial length R1 at a position closest to the toner discharge port 43 is the greatest, and the radial length is gradually reduced toward the other side R2 positioned furthest from the toner discharge port 43. Provided that the inner radius of the toner box 26 is R3, R1 is greater than R2, and R2 is greater than R3. The second agitation member 56 has a radial length R4 approximately equal to R3.

The first agitation member 55 is formed with a radially extending slit 55*a* at a boundary portion between the cylindrical intermediate portion 26*a* and a hexahedronal boxy portions 26*b*. Therefore, the first agitation member 55 is divided into a central area 55*c* and an end area 55*b* deformable independent of each other. Radial length R2 at the end area 55*b* is selected in such a way that the free edge of the end area approximately reaches the corner portion at a ceiling of the hexahedronal boxy portion 26*b*.

The first agitation members 55, 55 are spaced from each other so as to avoid interference with a developing agent remaining amount detecting portion 57*a*, 57*b* described later. A width of the second agitation member 56 in the axial direction of the shaft 53 is greater than a space between the two first agitation members 55 and 55.

Further, as shown in FIG. 14, a length L1 of the toner discharge port 43 in a longitudinal direction of the toner box 26 is made longer than a length L2 of the second agitation member 56. With this arrangement, when the agitator 52 is rotated in the upward direction, the free end of the second agitation member 56 moving upwardly is in frictional contact with the upper edge of the toner discharge port 43, and the toner 62 on the upper surface of the free end of the second agitation member 56 can be jumped toward the toner inlet port 41.

A pair of developing agent remaining amount detecting portions 57*a*, 57*b* are projected radially inwardly from the bottom surface of the intermediate portion of the toner box 26. The detecting portions are formed of a light transmissive material. A toner sensor 58 is provided to the detecting portion from outside. The toner sensor 58 is a photointerrupter having a light emitting portion and a light receiving portion. The toner sensor 58 is connected to a control device (not shown) of the printer.

A wiping member 60 is attached to the rotation shaft 53 by an arm 63. The wiping member is adapted for cleaning the confronting walls of the detecting portions 57*a*, 57*b* for wiping the toner 62 out of the confronting walls. The wiping member 60 includes the arm 63, a block 64 fixed to the free end of the arm 63, and cleaning brushes implanted on the right and left faces of the block 64. The brushes are adapted to wipe out the toners from the confronting surfaces of the detecting portions. Further, the wiping member 60 is also used for detecting remaining amount of the developing agents in the toner box 26. The block 64 implanted with the brushes is passable through a space defined between the developing agent remaining amount detection portions 57*a* and 57*b* for scraping up the toners accumulated therein. In accordance with the temporary removal of the toners from the space by the block 64, light from the light emitting portion 58 can be transmitted to the light receiving portion 58 for determination of the remaining toner amount. The control device (not shown) is adapted to detect the light transmitting period so as to determine the amount of the remaining toner.

The toner box 26 is detachably mounted on a pair of brackets 27*a* extending from the case 27 of the developing device 10 as shown in FIGS. 2, 3, 5, 6 and 7. To this effect, one longitudinal end portion of the toner box 26 is provided with a support boss portion 73 (FIG. 3) which protrudes outwardly from the longitudinal end portion thereof. The support boss portion 73 has generally a rhombic shape. Further, the one of the brackets 27*a* is formed with an L-shaped support groove 51 whose upper end is open. The rhombic support boss portion 73 is insertedly engaged with the support groove 51. With this arrangement, the support boss portion 73 is not rotatable within the support groove 51.

On the other hand, another end portion of the toner box 26 is provided with a circular support boss 74 which functions as a bearing for the one end portion of the rotation shaft 53. The other support boss 74 is supported by a support groove 51*a* (see FIG. 2) having L-shape configuration and an upper open end and formed at the other bracket 27*a*.

The support bosses 73 and 74 have shapes different from each other so that each maximum width is different from each other. With such an arrangement, attachment of the toner box 26 relative to the case 27 can be made only with a correct orientation or posture of the toner box 26. That is, with an erroneous attachment posture of the toner box to the case 27, even if the circular support boss portion 74 can be engaged with one of the support grooves 51, the rhombic support boss 73 cannot be engaged with the remaining support groove 51*a*. Therefore, attachment of the toner box 26 in its opposite erroneous posture to the case cannot be made. In other words, the rhombic support boss portion 73 cannot be engaged with the support groove 51*a*, if the toner box 26 is mounted such that the toner discharge port 43 of the toner box 26 is oriented to a direction opposite the partitioning wall 40.

Further, as described above, at least one of the support boss portion 73 has the generally rhombic shape. With this arrangement, the rotation of the toner box about an axis thereof can be prevented while the support boss 73 is engaged with the support groove 51. Therefore, even when a first wrapping member 45 and a second wrapping member 46 are rotated, the box 26 can be maintained non-rotated. Consequently, the opened toner discharge port 43 and the toner inlet hole 41 can be aligned with each other to avoid accidental leakage of the toners.

A pair of engagement projections 71, 71 protrude from the right and left sides of the first wrapping member 45. The engagement projections 71, 71 are engageable with the locking openings 70*a*, 70*a*. The engagement projections 71, 71 have an external perimeters smaller than a distance defined between the cut away grooves 42*a* and 42*a*.

Further, in order to avoid relative displacement between the toner box 26 and the case 27 when the toner box is installed on the case 27, a plurality of ribs 77, 77 having generally L-shape in cross-section are spacedly extend downwardly from the lower surface of the toner box 26. The upper surface of the bottom wall of the case 27 is formed with a plurality of guide grooves 78, 78 (see FIG. 12) engageable with the ribs 77, so that the ribs 77 is engaged with the guide grooves 78. Further, a gear cover 79 is provided to cover an upper half portion of the gear 54. The gear cover is provided integrally with the upper semi-cylindrical portion of the toner box 26.

Figure 6:
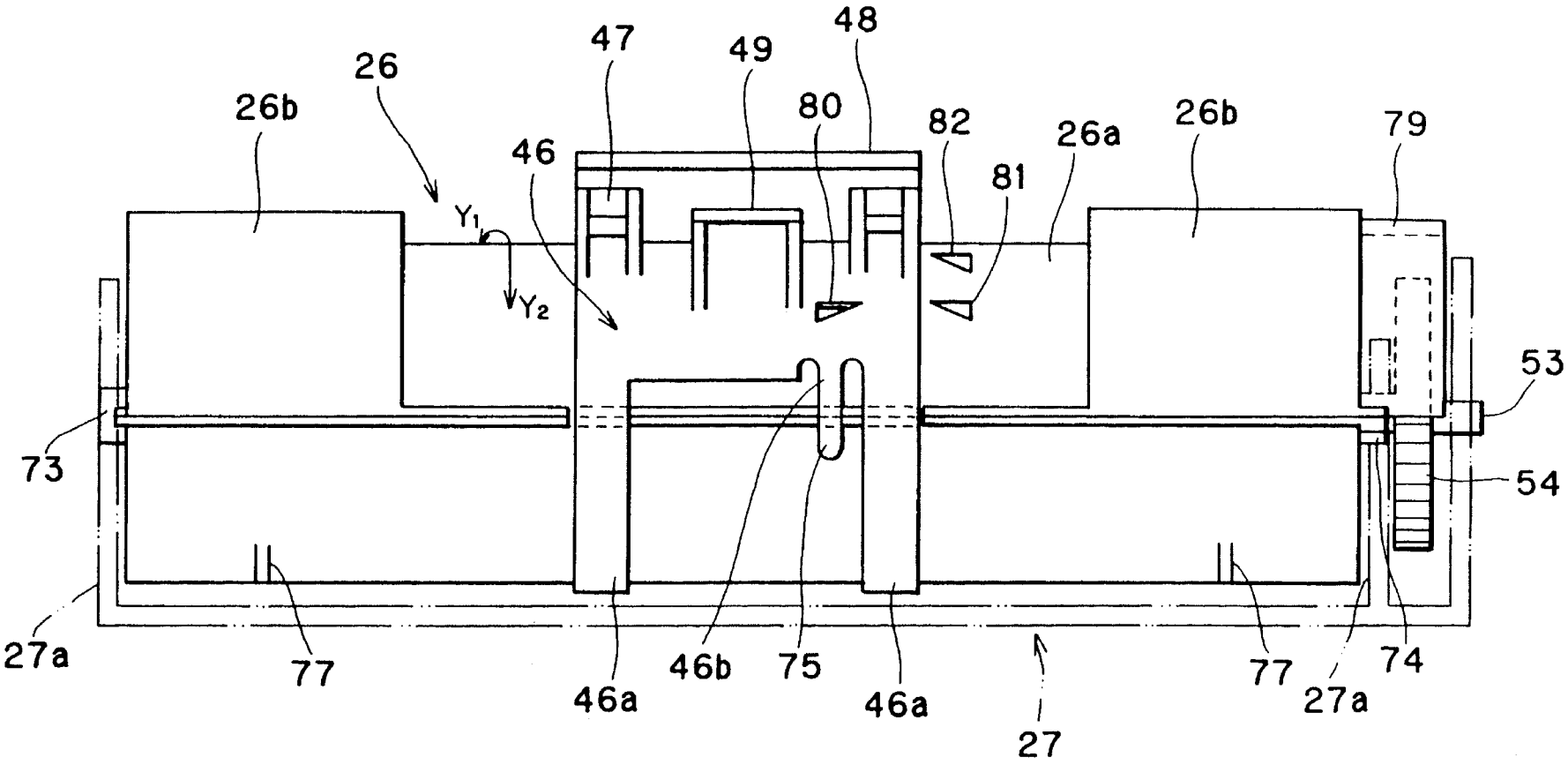
FIG. 6 is a rear view of the toner box.

As shown in FIGS. 4 and 6, the second wrapping member 46 has a triangular window 80. Further, at the outer peripheral surface of the intermediate portion 26*a* and at a portion not covered with the second wrapping member 46, red-colored and blue-colored identification marks 81 and 82 are provided. One of the marks 81 indicates a locking position (corresponding to the shut off position of the toner discharge port 43), and the other mark 82 indicates unlocking position (opening position of the toner discharge port 43). On the other hand, at the outer peripheral surface of the intermediate portion 26*a* and at a portion hidden by the second wrapping member 46, is adhesively fixed a sealing piece 83 (see FIG. 13) where two color marks 81*a*, 82*a* corresponding to the marks 81, 82 are provided at a position in confrontation therewith.

FIG. 16 shows a structure of a safety mechanism for inhibiting operation of the printer 1 in a state where the preparation for supplying toner 62 from the toner box 26 to the agitation chamber 30 has not yet been completed after the user installs the toner box 26 to the case 27. That is, attention is drawn to the fact that the image recording operation cannot be performed unless the sheet cassette 3 has been assembled to the main frame 2 of the printer 1. As shown in FIG. 16, the sheet cassette 3 is provided detachably in such a manner that its lower end portion 3*a* of the cassette 3 covers the upper portion of the toner box 26 when the toner box is installed on the case 27. The lower end portion 3*a* of the sheet cassette 3 is provided with a single rib 84 extending downwardly therefrom for the purpose of reinforcement of the cassette 3 and for serving as an interference portion. The rib 84 is positioned above the intermedaite portion of the toner box 26. The knob portion 48 is abutable against the rib 84 when the knob portion 48 is in its second position, i.e., vertically orienting position as shown by the solid line in FIG. 16 where the shutter portion 44 of the first wrapping member 45 covers the toner discharge port 43.

By this abutment, the sheet cassette 3 cannot be assembled to a given position of the main frame 2. As shown in FIG. 2, if the knob 48 is moved to its first position as shown by the chain line in FIG. 16 or moved toward the partitioning wall 40 so as to displace the discharge port shutter 44 from the toner discharge port 43 for opening the same, the knob 48 is moved away from the rib 84. Therefore, the sheet cassette 3 can be assembled to the given position as shown by a dotted chain line in FIG. 16.

Incidentally, since the position of the reinforcing and interfering rib 84 is displaced from the other knob portion 49 in a direction of a length L3 thereof, the rib 84 does not abut or interfere with the other knob portion 49 even if the knob portion 49 is directed in approximately vertical direction.

In operation, for forming an electrostatic latent image on the outer peripheral surface of the photosensitive drum 7, the photosensitive drum 7 is provisionally charged by the charger 23, and a laser beam is irradiated from the scanner unit 17 in accordance with image data transmitted from an external equipment such as a computer (not shown) onto the drum surface. Then, the developing sleeve 32 of the developing device 10 is rotated while supplying developing agents of magnetic powders to the surface of the photosensitive drum 7 so as to convert the latent image into a visible developing agent image. Then, the developing agent image is transferred onto the sheet P fed between the photosensitive drum 7 and the transfer roller 8. Thereafer, heat and pressure is applied to the transferred image at the fixing unit 13 for fixing the developing agent image onto the sheet P. The sheet P is discharged onto the discharge tray 25 by way of the pair of discharge rollers 24.

In the toner box 26, as shown in FIGS. 2 and 15, when the rotation shaft 53 of the agitator 52 is rotated in the direction A (that is, the shaft is rotated along the shortest distance bridging between the bottom of the toner box 26 and the toner discharge port 43 for scraping up the toner), the toner scraped up by the second agitation member 56 is discharged into the agitation chamber 30 through the toner discharge port 43, so that remaining toner amount at the intermediate portion 26*a* is reduced. On the other hand, as shown in FIG. 15, since the radial length of the first agitation member 55 at the center area is made longer, whereas the radial length thereof at the end area is made shorter towards its end, bending angle at the R1 portion is greater than that at the R2 portion when the first agitation member is moved along the uniform inner radius R3. Accordingly, the first agitation member 55 is deflected or slanted in such a manner that the rotation at the center area is delayed in comparison with the rotational movement at the end area. This slanting orientation can urge the scraped up toners toward the central area.

Further, the end area 55*b* of the first agitation member 55 is deflected substantially independently of the center area 55*c* because of the formation of the slit 55*a*. Therefore, the center area 55*c* can wipe the upper half zone of the cylindrical intermediate portion 26*a* of the toner box 26.

When the agitator 52 is rotated in the upward direction, the free end of the second agitation member 56 moving upwardly is in frictional contact with the upper edge of the toner discharge port 43, and the toners 62 on the upper surface of the free end of the second agitation member 56 can be jumped toward the toner inlet port 41.

Further, in accordance with the rotation of the rotation shaft 53 in the direction A, the wiping member 60 is also moved in the direction of the arrow A, and the wiping member passes between the pair of the developing agent remaining amount detection portions 57*a*, 57, while the wiping member scrapes up the toners 62. In this instance, light from the light emitting portion 58 is received in the light receiving portion 58. Thereafter, the toners 62 drop onto a portion between the detecting portions 57*a* and 57*b* to bury the space defined therebetween. Accordingly the light is shut off. If the large amount of toners remains in the toner box 26, is short a time period T (ON period of the toner sensor 58) starting from the light reception timing at the light receiving portion and ending at the light shut-off timing. The time period T becomes longer in accordance with the reduction in remaining amount of the toners. If the toner remaining amount is excessively reduced, the light receiving portion continuously receives light. The control device (not shown) of the printer detects the remaining amount of the toners on a basis of the data of the time period T.

The toners supplied from the toner box 26 are spread toward a full length of the opening portion 36 and are directed into the developing chamber 34. That is, as shown in FIG. 2, the second agitator 31 is rotated in a direction indicated by the arrow B, so that the developing agents in the agitation chamber 30 are scraped up from the bottom of the chamber 30 to the opening portion 36. The first agitator 33 is rotated in the direction indicated by the arrow C, so that the developing agents supplied through the opening 36 and magnetic carriers provisionally stored in the developing chamber 34 are agitated together, and are jumped up toward the lower surface of the developing sleeve 32. The toners are then transferred onto the outer peripheral surface of the photosensitive drum 7.

Prior to the installation of the toner box 26 into the developing case 27, the resiliently deformable locking pawl pieces 42*b* of the inlet port shutter 42 are engaged with the respective locking openings 70*a*, so that angular rotational position of the inlet port shutter 42 with respect to the partitioning wall 40 can be fixed at the toner inlet port closing position. Further, the locking pawl 75 is engaged with the projection 76 at the mating face between the upper and lower semicylindrical case halves of the toner box 26. Therefore, the discharge port shutter 44 is positioned immovably for maintaining the closing state as shown in FIG. 17(*a*).

For assembling the toner box 26 into the developing case 27, the toner box 26 is postured such that the generally rhombic support boss portion 73 and the generally circular support boss portion 74 are to be engaged with the groove 51 and groove 51*a*. If the toner box 26 is in an erroneous attachment posture, even if one of the support boss portions 74 can be engaged with one of the support grooves 51, the remaining support boss 73 cannot be engaged with the remaining support groove 51*a*. Therefore, attachment of the toner box 26 in its opposite erroneous posture to the case cannot be made with the erroneous posture. In this way, the toner box 26 can be installed to the developing case 27 with the correct orientation or posture.

By the accurate installation, the toner discharge port 43 is positioned in confrontation with the toner inlet port 42. Further, because of the correct installation, interlocking relationship between the discharge port shutter 44 and the inlet port shutter 42 can be performed. Furthermore, it is also possible to avoid toner leakage.

Upon correct installation of the toner box 26 into the case 27, the protrusion 27*b* of the toner case 27 is urgingly brought into engagement with the locking pawl 75 as shown in FIG. 17(*b*), so that the locking pawl 75 is disengaged from the projection 76 because of the resilient deformation of the deformable arm 46*b*. Thus, the second wrapping member 46 can become rotatable. Furthermore, upon installation of the toner box 26, the rhombic shaped boss portion 73 is engaged with the groove 51. Therefore, the rotation of the toner box 26 is prevented. Consequently, even after the toner discharge port 43 and the toner inlet port 41 are opened, these ports can be aligned with each other to avoid accidental toner leakage. Furthermore, the sealing members 66, 67 seal boundaries between the shutters 42, 44 and the ports 41, 43 to avoid accidental leakage of the toners. Furthermore, the ribs 77 of the toner box 26 are engaged with the plurality of guide grooves 78, so that relative displacement between the toner box 26 and the case 27 does not occur.

Upon completion of the installation of the toner box 26 into the developing case 27, the knob portion 48 is accessible. However, if the knob 48 is not manipulated for opening the ports 43, 41, i.e., if the knob 48 has the upstanding posture shown by the solid line in FIG. 16, and if the operator attempts to install the sheet cassette 3 into the main frame 2, the cassette 3 cannot be assembled to a given position due to the abutment between the upstanding knob 48 and the rib 84. In other words, even if the toner box 26 is correctly assembled to the case 27, the interfering portion or the rib 84 provided at the lower end portion of the sheet cassette 3 is interfered with the knob portion 48 as long as the discharge port shutter 44 is not rotationally moved for providing communication between the toner discharge port 43 and the toner inlet port 41. Therefore, the sheet cassette 3 cannot be installed to its normal position. Consequently, it is possible to avoid break down of the developing device and the image recording apparatus due to non supply of toners to the developing device while starting the image recording operation. Thus, safety image recording operation can be provided.

As described above, in the state where the support bosses 73, 74 of the toner box 26 are engaged with the supporting grooves 51, 51*a* of the pair of brackets 27*a*, 27*a*, the engagement projections 71, 71 of the first wrapping member 44 are fitted into the engagement openings 70*a*, 70*a* of the pair of guide grooves 70, 70 of the partition wall 40. Therefore, the resilient locking pawl pieces 42*b* are pressed by the engagement projections 71, 71, and consequently locking engagement between the locking pawl pieces 42*b* and the locking openings 70*a* is released by the engagement projections 71, 71.

In this case, the engagement projections 71, 71 of the first wrapping member 45 are brought into engagement between the pair of upper and lower cut-away grooves 42*a*, 42*a* of the inlet port shutter 42. With this state, if an operator grips the knob portion 48 and moves the same in the direction Y1 and aligns the window 80 with the mark 82*a*, the discharge port shutter 44 of the first wrapping member 45 is displaced from the toner discharge port 43 and the opening portion 50 confronts the toner discharge port 43, At the same time, the inlet port shutter 42 is also angularly rotated for opening the toner inlet port 41 when the first wrapping member 45 is rotated in the direction indicated by the arrow Y1, because the resilient locking pieces 42*b*, 42*b* are already disengaged from the locking openings 70*a*, 70*a* and the engagement projections 71, 71 are engaged with the cut-away grooves 42*a*, 42*a*. In other word, the inlet port shutter 42 is movable interlockingly with the movement of the first wrapping member 45 or the discharge port shutter 44. In this case, the sealing members 66, 67 are in abutment with each other to avoid accidental leakage of the toners 62.

In accordance with the displacement of the first wrapping member 45, the second wrapping member 46 is also angularly moved so that the knob portion 49 is also angularly moved. In the state where the ports 43 and 41 are communicated with each other, the knob portion 48 cannot be accessible, since the knob portion 48 is positioned deep into the image recording apparatus as shown by the dotted chain line in FIG. 16. However, the other knob portion 49 is still accessible. For closing the ports 43 and 41, by gripping the knob portion 49 and rotating the second wrapping member 46 in the direction Y2 and by aligning the window 80 with the mark 81*a*, the toner discharge port 43 is covered with the discharge port shutter 44 of the first wrapping member 45, and at the same time the inlet port shutter 42 is moved to cover the inlet port shutter 42 because of the interlocking relationship between the shutters 42 and 44. The sealing piece 83 having a plurality of marks 81*a*, 82*a* can provide easy handling or using manner of the toner box 26 for the user.

When the toner inlet port 41 is shut off by the inlet port shutter 42 by rotating the wrapping members 45, 46 in the Y2 direction, the locking pawl pieces 42*b* of the inlet port shutter 42 are aligned with the locking openings 70*a* of the partitioning wall 40. If the toner box 26 is detached from the developing case 27, the inlet port shutter 42 is non-rotatably locked at a position because of the engagement of the locking pawl pieces 42*b* with the locking openings 70*a*. Thus, the free movement of the inlet port shutter 42 is prevented, and the shutter 42 keeps closing of the toner inlet port 41. Further, in this case, the sealing member 66 seals the boundary between the discharge port shutter 44 and the port 41. The sealing member 67 seals the boundaries between the discharge port shutter 44 and the port 43.

As described above, the shutters 44, 42 are of arcuate shape approximately concentrical with the cylindrical portion of the toner box 26. Further, the toner box 26 has the elongated cylindrical shape extending in approximately horizontal direction and the toner box has a cylindrical part at which the toner discharge port 43 is formed which confronts the toner inlet port 41 of the case 27. Therefore, during angular rotation of the first and second wrapping members 45, 46, the discharge port shutter 44 is always positioned adjacent the outer peripheral surface of the cylindrical toner box in both toner discharge port opening and closing states, and the discharge port shutter 44 does not largely protrude from the toner box 26. Accordingly, in spite of the movement of the discharge port shutter 44, it is possible to avoid contamination of ambient components and a user's hand with toner particles which may be affixed to the discharge port shutter 44.

Further, in the developing device according to the depicted embodiment, the toner case 27 is provided with the inlet port shutter 42 for closing the toner inlet port 41, the inlet port shutter 42 being movable concentrically with the moving direction of the discharge port shutter 44, and the discharge port shutter 44 has engaging means 71 engageable with locking means 42*a* of the inlet port shutter 42 for interlockingly moving the inlet port shutter 42 in accordance with the opening and closing angular rotational movement of the discharge port shutter 44 through the engagement means 71 and the locking means 42*a* in a state where the toner box is installed to the case. Accordingly, the engaging means 71 of the discharge port shutter 44 is automatically engaged with and disengaged from the locking means 42*a* of the inlet port shutter 42 in accordance with the attaching and detaching work of the toner box 26 relative to the case 27.

Further, because of the interlocking movement between the shutters 44 and 42, communication between the toner box 26 and the developing chamber 34 can be performed at one time, which can facilitate handling of the developing device.

Furthermore, in the illustrated embodiment, the sheet cassette 3 is only installable provided that the discharge port shutter 44 and the inlet port shutter 42 open the corresponding ports 43, 41. Therefore, toner is surely supplied to the developing area once the sheet cassette 3 is installed onto the image recording apparatus. Furthermore, in the illustrated embodiment, the toner box 26 can be installed into the developing case 27 with a correct orientation and posture because of the provision of the support boss portions 73, 73 having external perimeters different from each other.

While the invention has been described in detail and with reference to the specific embodiment thereof, it would be apparent to those skilled in the art that various changes and modifications may be made therein without departing from the spirit and scope of the invention.

For example, in the illustrated embodiment, the support bosses 73 and 74 have shapes different from each other, one is rhombic and the other is circular, so that each maximum width is different from each other. However, the support bosses can have both cylindrical shape but have diameters different from each other. Further, instead of the single rib 84, a plurality of ribs 84 can be provided. Furthermore, in the illustrated embodiment, the brushes are used to wipe out the toners from the confronting surfaces of the detecting portions a, 57*b*. However, a flexible film is available instead of the brushes.

What is claimed is:

1. A toner containing device comprising:

a toner box suitable for holding a predetermined amount of toner, the toner box including a toner discharge opening;

a shaft rotatably mounted to rotate within the toner box;

at least one agitating blade fixed to said shaft and extending radially from said shaft, said at least one agitating blade having a first radial length and a second radial length different from the first radial length.

2. A toner containing device according to claim 1, wherein the at least one agitating blade is at least one first agitating blade, and further comprising a second agitating blade fixed to the shaft and aligned with the toner discharge opening.

3. A toner containing device according to claim 1, wherein the at least one first agitating blade and the second agitating blade are fixed along different circumferential portions of the shaft.

4. A toner containing device according to claim 3, wherein an angle between the at least one first agitating blade and the second agitating blade is approximately 90 degrees.

5. A toner containing device according to claim 1, wherein the at least one first agitating blade is a flexible member, the first radial length is disposed nearest the toner discharge opening, and the first radial length is greater than the second radial length.

6. A toner containing device according to claim 5, wherein the toner box includes an interior having a third radial length, and the third radial length is less than both the first and second radial lengths.

7. A toner containing device according to claim 1, wherein said toner box has a cylindrical portion and a hexahedronal portion connected by a boundary portion.

8. A toner containing device according to claim 7, wherein the at least one agitating blade includes a radial slit between the first and second radial lengths, said radial slit being aligned with the boundary portion of the toner box to allow independent action of each portion of the at least one agitating blade on opposite sides of the radial slit.

9. A toner containing device according to claim 1, wherein said at least one agitating blade comprises two first agitating blades axially spaced on the shaft on opposite sides of the toner discharge opening.

10. A toner containing device according to claim 9, further comprising a second agitating blade fixed to the shaft between and circumferentially spaced from said two axially spaced first agitating blades, said second agitating blade being aligned with said toner discharge opening.

11. A toner containing device according to claim 10, wherein the second agitating blade has a first width at a free end thereof less than a second width of the toner discharge opening, the toner box includes a third radial length that is about equal to a fourth radial length of the second agitating blade, and wherein the second agitating blade is flexible such that the free end urges toner through the toner discharge opening upon rotation of the shaft.

12. A toner containing device according to claim 9, further comprising means for establishing toner flow from the each end of the toner box toward the toner discharge opening.

13. A toner containing device according to claim 1, wherein the toner discharge opening is positioned along an intermediate portion of the toner box, and wherein said at least one agitating blade includes two first agitating blades axially spaced on opposite sides of the toner discharge opening and located on opposite ends of the shaft, said two first agitating blades having profiles that mirror one another and are different from one another as viewed from one longitudinal side of the toner box.

14. A toner containing device according to claim 1, wherein said toner box includes two differently shaped bosses positioned on each exterior end of the toner box, and wherein each of said two differently shaped bosses mates with a matched support groove in only in a predetermined orientation.

15. A toner containing device according to claim 1, wherein said first and second radial lengths are contained in a common plane.

16. A toner box comprising:

a toner body having a toner discharge opening;

a shaft rotatably mounted to rotate within the toner body;

a first agitating blade on each end of the shaft on opposite sides of the toner discharge opening, each said first agitating blade having a substantially trapezoidal shape.

17. A toner box according to claim 16, wherein each trapezoidal shape includes a first dimension radially extending from the shaft that is greater than a second dimension radially extending from the shaft, said first dimension being closer to the toner discharge opening than the second dimension.

18. A toner box according to claim 17, wherein each first agitating blade is flexible such that a first bending angle of the first dimension is greater than a second bending angle of the second dimension to promote flow from each end of the toner body toward the toner discharge opening.

19. A toner box according to claim 16, further comprising a second agitating blade fixed to the shaft and aligned with the toner discharge opening.

20. A toner box according to claim 19, wherein each first agitating blade and the second agitating blade are fixed along different circumferential portions of the shaft.

21. A toner box according to claim 19, wherein the second agitating blade has a first width at a free end thereof less than a second width of the toner discharge opening, and wherein the second agitating blade is flexible such that the free end urges toner through the toner discharge opening upon rotation of the shaft.

22. A toner box according to claim 16, wherein each first agitating blade includes a radial slit to allow independent action of each portion of each said first agitating blade on opposite sides of the radial slit.

23. A toner box according to claim 16, further comprising means for establishing toner flow from the each said end of the toner body toward the toner discharge opening.

24. A toner box comprising:

a toner body having a toner discharge opening;

a shaft rotatably mounted to rotate within the toner body;

an agitating blade on each end of the shaft on opposite sides of the toner discharge opening, each said agitating blade being deformed against an inside surface of the toner body; and means integral with each agitating blade for establishing toner flow from the each end of the toner body toward the toner discharge opening.

25. A toner box comprising:

a toner body having a toner discharge opening;

a shaft rotatably mounted to rotate within the toner body;

a side agitating blade on each end of the shaft on opposite sides of the toner discharge opening; and a central agitating blade arranged on the shaft and disposed in substantial alignment with the toner discharge opening, wherein a free, uncompressed length of the central agitating blade is greater than an inside radial dimension of the toner body such that the free end springingly urges toner through the toner discharge opening upon rotation of the shaft.

26. A toner box according to claim 25, further comprising means for establishing toner flow from the each end of the toner body toward the toner discharge opening.

27. A toner box according to claim 25, wherein a free, uncompressed length of each side agitating blade is greater than and contacts an inside radial dimension of the toner body.

28. A method of feeding toner into a development chamber of a development device, said method comprising:

providing toner within a toner body having a toner discharge opening;

arranging a flexible central agitating blade on a portion of a rotatable shaft substantially aligned with the toner discharge opening;

deforming the central agitating blade against an inner surface of the toner box thereby building potential energy of the central agitating blade; and springingly urging toner from the central agitating blade through the toner discharge opening, thereby releasing said potential energy upon each complete rotation of the shaft.

* * * * *